US006145681A

United States Patent [19]

Chimetto et al.

[11] Patent Number: 6,145,681

[45] Date of Patent: Nov. 14, 2000

[54] BOTTLE WITH ANNULAR GROOVE

[75] Inventors: Fabio Chimetto, Piazzola sul Brenta; Loris Favero, Udine, both of Italy

[73] Assignee: Acqua Vera S.p.A., San Giorgio in Bosco, Italy

[21] Appl. No.: 09/205,102

[22] Filed: Dec. 3, 1998

[30] Foreign Application Priority Data

Dec. 24, 1997 [IT] Italy ..... RM970279 U

[51] Int. Cl.[7] ..... B65D 90/02

[52] U.S. Cl. ..... 215/384; 220/669

[58] Field of Search ..... 215/382, 383, 215/384; 220/660, 666, 669, 673, 675; D9/538, 530, 536, 537, 539, 541, 552, 557, 556, 565, 569

[56] References Cited

U.S. PATENT DOCUMENTS

| | | | |
|---|---|---|---|
| D. 70,765 | 8/1926 | Jones | D9/538 |
| D. 101,483 | 10/1936 | Mott | D9/538 |
| D. 115,155 | 6/1939 | D'addario | D9/538 |
| D. 186,085 | 9/1959 | Dallas | D9/552 |
| D. 216,361 | 12/1969 | Pappas | D9/538 |
| D. 230,136 | 1/1974 | Strand | D9/552 |
| D. 286,617 | 11/1986 | Goodwin et al. | D9/538 |
| D. 376,319 | 12/1996 | Miller | D9/538 |
| D. 389,068 | 1/1998 | Hooker | D9/538 |
| 2,899,110 | 8/1959 | Parker | 215/383 |
| 3,536,500 | 10/1970 | Cleereman et al. . | |
| 5,201,438 | 4/1993 | Norwood . | |
| 5,209,372 | 5/1993 | Norwood | 215/383 X |
| 5,449,089 | 9/1995 | Turner et al. | 220/675 |
| 5,704,504 | 1/1998 | Bueno | 215/383 X |

FOREIGN PATENT DOCUMENTS

| | | |
|---|---|---|
| 0679580 | 11/1995 | European Pat. Off. . |
| 2258209 | 2/1993 | United Kingdom . |

*Primary Examiner*—Stephen P. Garbe
*Assistant Examiner*—Tri M. Mai
*Attorney, Agent, or Firm*—Browdy and Neimark

[57] ABSTRACT

A bottle providing an eased grip and comprising a hollow elongated body provided with an annular groove in an intermediate position to allow the grip of the bottle itself, said annular groove having a plurality of ribs passing through the surface of the annular groove from side to side, uniformly placed along the side surface thereof.

12 Claims, 2 Drawing Sheets

BOTTLE WITH ANNULAR GROOVE

BACKGROUND OF THE INVENTION

1. Field of the Invention

The present invention relates to a bottle comprising a hollow elongated body extending between a bottle bottom and a bottle neck, wherein said elongated body comprises an upper region, a lower region and it is provided with an annular groove provided therebetween for an eased grip.

2. Description of the Prior Art

This kind of bottle is apt to contain liquids like mineral water or other beverages and it has for example a 1.5 or 2 liters capacity. The body of the bottle is usually made of terephthalate polyethylene (PET) or other similar plastic materials, for example by a blow molding method.

The annular groove serves as a region for holding the bottle, gripping the recessed circumference of the groove having a reduced diameter with respect to the transverse dimensions of the bottle.

Said bottles are sometimes difficult to hold. In fact, it is necessary to hold said annular groove tight, both for the condensation, that might form on the refrigerated surface of the bottle, and for the weight of the content.

Too much pressure exerted by a user on the annular groove can cause the deformation of the bottle, with a consequent uncontrolled outflow of the liquid content. On the other hand, user's fingers can somehow slip on the surface of the annular groove causing the user to lose the grip.

SUMMARY OF THE INVENTION

An object of the present invention is to provide a bottle overcoming the drawbacks mentioned with reference to the state of the art.

Such an object is achieved by a bottle comprising a hollow elongated body extending between a bottle bottom and a bottle neck, wherein said elongated body comprises an upper region, a lower region and an annular groove provided therebetween, said annular groove having a plurality of ribs passing through the lateral surface of the annular groove.

The main advantage of the bottle according to the present invention is that a tighter grip as well as an eased holding are enabled.

According to a preferred embodiment of the present invention, the bottle is provided with uniformly placed ribs having a sinuous profile and being substantially spirally oriented.

Preferably, at the annular groove the ribs are raking and closely approached to each other, making the groove stiffened without increasing the plastic thickness.

Also disclosed is a method of holding a bottle as above specified, comprising the steps of providing said annular groove with a plurality of ribs passing through the lateral surface of the annular groove; and of gripping said annular groove with a user's hand.

The present invention will be illustrated herebelow by referring to a preferred embodiment thereof, explained by way of a non-limiting example.

DESCRIPTION OF THE PREFERRED EMBODIMENT

With reference to the figures, a bottle of the type used to contain mineral water having a capacity of 1.5 or 2 liters is indicated 1 a whole.

Figure 1:
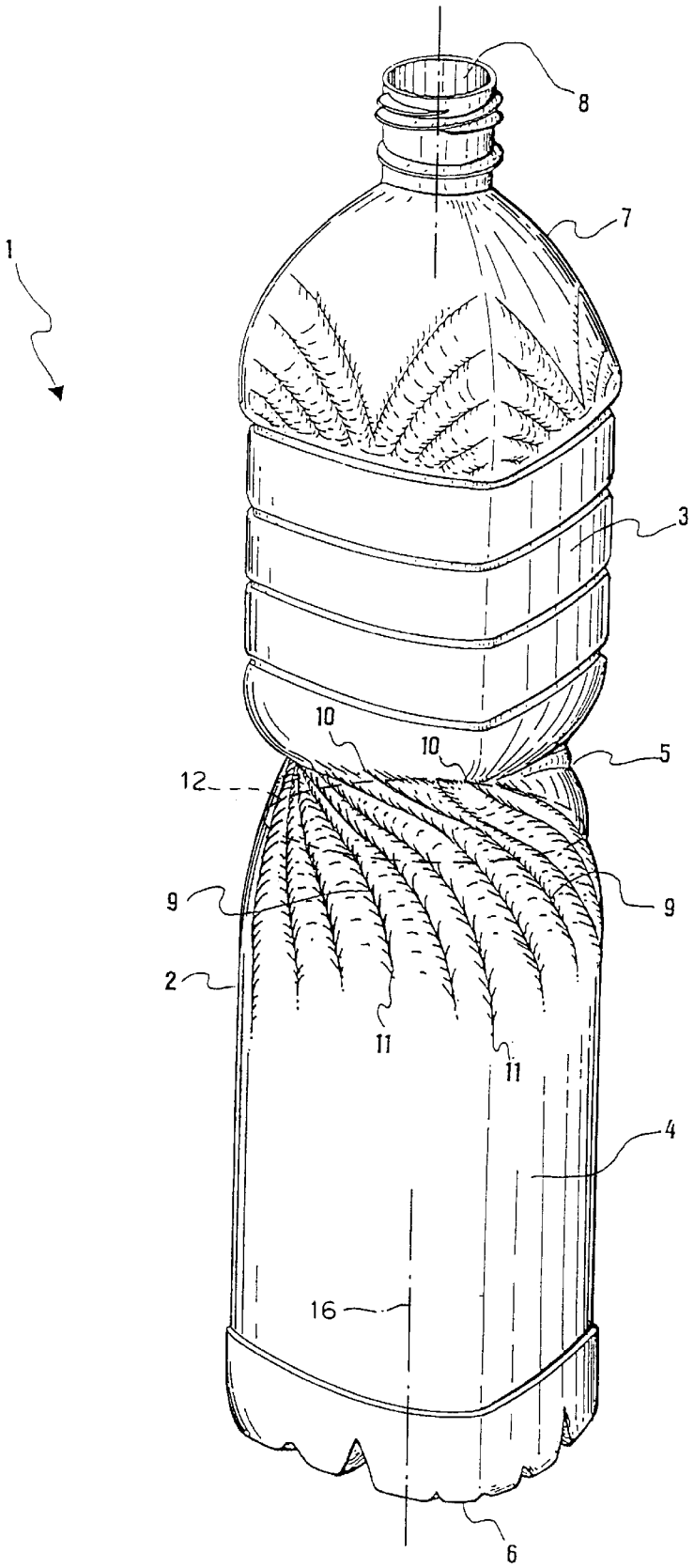
FIG. 1 shows a perspective view of the bottle according to the present invention.

Said bottle 1 is made of terephthalate polyethylene (PET) and comprises an elongated hollow body 2 defined by an upper region 3 and a lower region 4. As seen in FIG. 1, the upper region and the lower region are generally similar in height.

The bottle 1 has an annular groove 5 shaped between said upper and lower regions 3, 4. It is provided in an intermediate position, slightly shifted toward the top of the bottle 1.

The annular groove 5 is defined by a circular recess, being substantially a depression, apt to be held by a user to handle the bottle 1 having a reduced transverse dimension.

In the present embodiment the bottle 1 has upper and lower regions 3 and 4 having a square section with convex sides, while the annular groove 5 includes generally circular cross-sections 12 perpendicular to the longitudinal axis 16 of the bottle 1.

Furthermore, the bottle 1 comprises a bottle bottom 6, in the lower region 4, and a bottle neck 7, in the upper region 3, ending with an threaded opening 8 apt to be closed by a closure cap of the usual type.

In the bottle 1 according to the present embodiment, the annular groove 5 is such as to have a plurality of ribs 9 passing through the whole groove 5 from side to side, said ribs 9 having respective upper and lower ends 10 and 11 laying in the corresponding upper and lower regions 3 and 4.

The ribs 9 are groove-shaped beads, projecting themselves inside the bottle 1 and hence forming on the side surface of the annular groove 5 a plurality of winkled beads both to stiffen the whole bottle 1 and to enable a tighter holding with their winkled shape 15.

Obviously, the part of elongated body 2 that is strengthened the most is indeed the annular groove 5 which is to be held by the user.

The ribs 9, i.e. the beads of the present embodiment, are uniformly placed along the whole side surface of the annular groove 5, i.e. they are provided with a uniform pitch along the internal circumference of the groove 5, and, considering that they branch along the upper and lower regions 3 and 4, they guarantee the largest possible gripping surface. Moreover, the beads are closely approached and adjacent to each other.

This uniform distribution makes the grip firm regardless from the point wherein the bottle is held.

The ribs 9 have a sinuous profile and are substantially spirally oriented, as if they were the result of a 90° twist of the upper and lower regions 3 and 4, into the ribs 9 previously parallel to the axis of the elongated body 2.

In particular, each upper end 10 lays on a point of a face of the upper region 3 corresponding to an analogous point, wherein the lower end 11 is situated, belonging to an adjacent face of the bottle 1 on the lower region 4.

Figure 2:
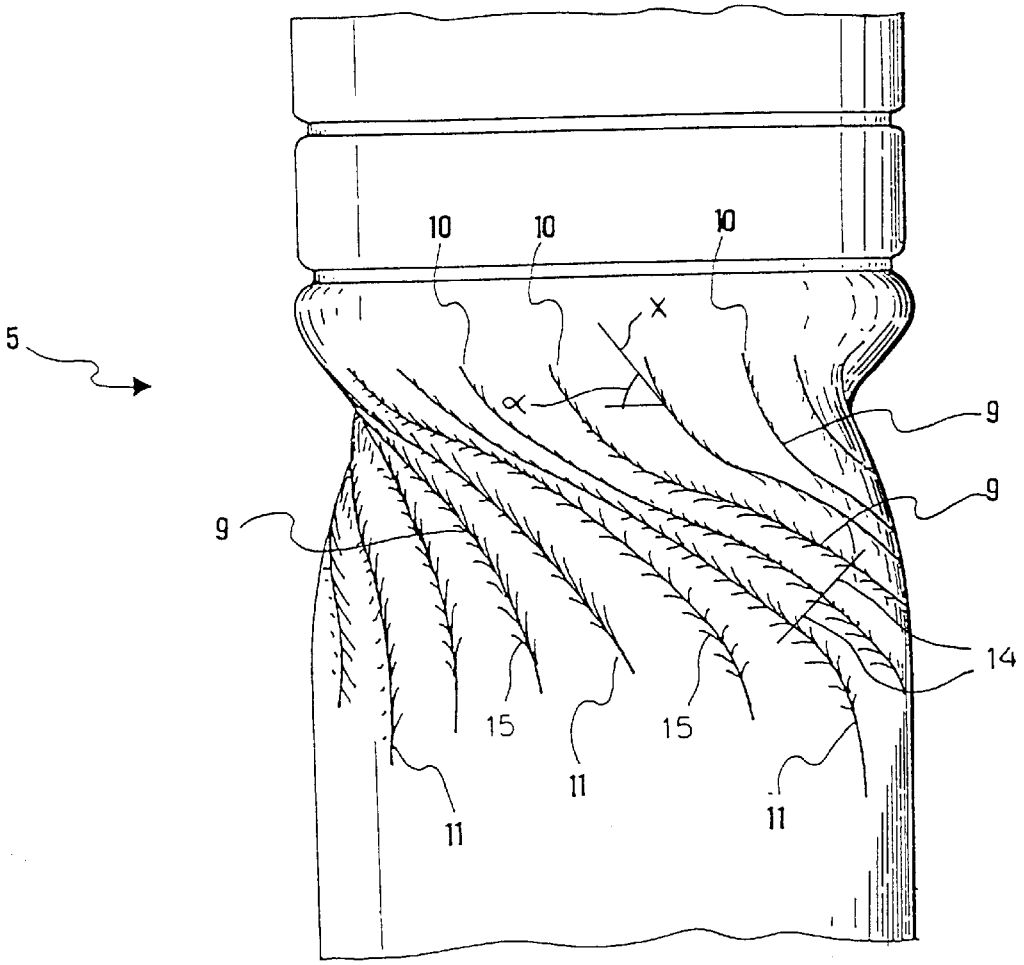
FIG. 2 shows an enlarged lateral view of a detail of the bottle of FIG. 1.

At the annular groove 5, the ribs are raking and any tangent X to the edges of ribs 9 has a maximum angle of 45° to the longitudinal axis 16 at the recessed rim of the annular groove 5 as shown in FIG. 2.

As a consequence of the inclination and of the diameter reduction, the ribs 9 thicken in the center of the annular groove 5, therefore improving the overall strength.

Advantageously, the number of ribs 9 is equal to or higher than 15. In the present embodiment of the invention, the annular groove 5 is passed through by twenty ribs 9, i.e. each face of the upper region 3 has five upper ends 10 of the ribs 9 which find their respective lower end 11 on an adjacent face of the lower region 4.

The present embodiment can undergo various modification included in the same innovative concept. In particular, the particular structure of the annular groove 5 is suitable not only for circular sections, as well as the sections of the upper and lower regions 3 and 4 that can be differently shaped from square, and in particular circular.

According to the present embodiment, a method for holding said bottle 1 comprises the step of: providing the above defined annular groove 5 with the above described plurality of ribs 9; and gripping said annular groove with a user's hand.

Further to the above mentioned advantage, another advantage of the present invention is that the stiffening of the bottle caused by the ribs enables a remarkable reduction of the total weight of the bottle itself and therefore a saving in production costs.

The present invention has been up to now described with reference to some of its forms of preferred embodiment, given as non-limiting example. Therefore, it is to be understood that various and different modifications can be carried out, without departing thereby from the protective scope of the invention.

What is claimed is:

1. A bottle including a hollow elongated body including an upper region, a lower region, and an annular groove, the annular groove being disposed between the upper region and the lower region and comprising a recessed lateral surface;

said recessed lateral surface including a recessed circumference less than a transverse dimension of the upper region or the lower region;

said recessed later surface comprising a plurality of ribs, of a wrinkled shape, passing through substantially the whole annular groove, said ribs including upper and lower ends adjoining the upper region and the lower region respectively;

said ribs being uniformly placed on the lateral surface of the annular groove;

each of said ribs including a sinuous profile, being spirally oriented, and having a grooved-shaped bead which thickness at the recessed circumference; and wherein the upper region and the lower region include a generally square cross section, whereby the bottle includes four upper faces and four lower faces.

2. The bottle according to claim 1, wherein the ribs number at least fifteen.

3. The bottle according to claim 1, wherein the ribs number twenty.

4. The bottle according to claim 1, comprising a capacity of 1.5 liters.

5. The bottle according to claim 1, comprising a capacity of 2.0 liters.

6. The bottle according to claim 1, wherein the annular groove includes generally circular cross-sections taken perpendicular to the longitudinal axis of the bottle.

7. The bottle according to claim 1, wherein a tangent to the recessed edges of the ribs make an angle of up to 45° with a longitudinal axis of the bottle.

8. The bottle according to claim 1, wherein the ribs include a uniform pitch.

9. The bottle according to claim 1, wherein each rib includes an upper end and a lower end, and wherein each rib extends from a point along one of the upper faces to a corresponding point on a one of the lower faces adjoining a lower face below the one of the upper faces.

10. A method for a user, having a hand, to hold the bottle according to claim 1, comprising:

providing the bottle; and gripping the annular groove with the hand.

11. The method according to claim 10, wherein the ribs number at least fifteen.

12. The method according to claim 10, wherein the ribs number twenty.

* * * * *